US007078374B2

(12) United States Patent
Howard et al.

(10) Patent No.: US 7,078,374 B2
(45) **Date of Patent: *Jul. 18, 2006**

(54) METHOD OF PREPARING FABRIC CONDITIONING COMPOSITIONS

(75) Inventors: Jane Howard, Merseyside (GB); Kevin Anthony Ormandy, Merseyside (GB); John Stuart Parsons, Merseyside (GB)

(73) Assignee: Unilever Home & Personal Care USA division of Conopco, Inc., Greenwich, CT (US)

( * ) Notice: Subject to any disclaimer, the term of this patent is extended or adjusted under 35 U.S.C. 154(b) by 247 days.

This patent is subject to a terminal disclaimer.

(21) Appl. No.: 10/363,593

(22) PCT Filed: Aug. 24, 2001

(86) PCT No.: PCT/EP01/09882

§ 371 (c)(1),
(2), (4) Date: Jul. 18, 2003

(87) PCT Pub. No.: WO02/20706

PCT Pub. Date: Mar. 14, 2002

(65) Prior Publication Data

US 2004/0014632 A1 Jan. 22, 2004

(30) Foreign Application Priority Data

Sep. 5, 2000 (GB) ..... 0021765.3

(51) Int. Cl.
*C11D 1/835* (2006.01)

(52) U.S. Cl. ..... 510/527; 510/522

(58) Field of Classification Search ..... 510/522, 510/527

See application file for complete search history.

(56) References Cited

U.S. PATENT DOCUMENTS

| | | | | |
|---|---|---|---|---|
| 3,974,076 | A | 8/1976 | Wiersema et al. | |
| 5,066,414 | A | 11/1991 | Chang | |
| 5,531,910 | A | 7/1996 | Severns et al. | |
| 5,574,179 | A | 11/1996 | Wahl et al. | |
| 5,643,865 | A | 7/1997 | Mermelstein et al. | |
| 5,726,144 | A * | 3/1998 | Dewez et al. | 510/522 |
| 5,767,052 | A | 6/1998 | Shaw, Jr. et al. | |
| 5,856,287 | A * | 1/1999 | Motyka et al. | 510/342 |
| 5,964,939 | A | 10/1999 | Fox et al. | |
| 5,985,820 | A | 11/1999 | Khan-Lodi et al. | |
| 6,004,913 | A | 12/1999 | Iacobucci et al. | |
| 6,057,285 | A | 5/2000 | Pescador et al. | |
| 6,303,565 | B1 * | 10/2001 | Clarke et al. | 510/527 |

FOREIGN PATENT DOCUMENTS

| | | |
|---|---|---|
| EP | 0 309 052 | 3/1989 |
| EP | 730023 A2 * | 9/1996 |
| EP | 0 503 221 | 2/1998 |
| EP | 0 640 121 | 7/1999 |
| EP | 0 734 433 | 3/2000 |
| GB | 2 170 829 | 8/1986 |
| WO | 93/23510 | 11/1993 |
| WO | 94/20597 | 9/1994 |
| WO | 95/31524 | 11/1995 |
| WO | 96/21715 | 7/1996 |
| WO | 97/16516 | 5/1997 |
| WO | 97/34972 | 9/1997 |
| WO | 99/29823 | 6/1999 |
| WO | 99/50378 | 10/1999 |
| WO | 01/46360 | 6/2001 |
| WO | 01/96510 | 12/2001 |

OTHER PUBLICATIONS

UK Search Report No. GB 0021765.3 dated Feb. 7, 2001—1 p.
UK Search Report No. GB 0021766.1 dated Feb. 7, 2001—1 p.
Int'l. Search Report No. PCT/EP 01/09882 dated Jan. 14, 2002—4 pp.
Int'l. Search Report No. PCT/EP 01/09884 dated Apr. 24, 2002—5 pp.

* cited by examiner

*Primary Examiner*—John R. Hardee
(74) *Attorney, Agent, or Firm*—Rimma Mitelman

(57) ABSTRACT

A method of preparing an aqueous dispersion of a fabric conditioning composition comprises mixing 7.5 to 60% by weight of a cationic fabric softening compound, the compound having one or more hydrocarbyl chains formed from parent fatty acyl compounds or fatty acids having an iodine value of from 0 to 20 with 0.01%–1.5% by weight of a nonionic surfactant viscosity modifier and up to 1.4% by weight of a fatty alcohol, the combination of (b) and (c) being no more than 1.5% by weight, based on the total weight of the composition, the aqueous dispersion being subjected to high-shear below the phase transition temperature of compound (a) for a time sufficient to provide a composition having a viscosity of from 10 to 250 mPa·s measured at 20 s−1 using a Haake NV1 Rotoviscometer at 20° C.

8 Claims, No Drawings

METHOD OF PREPARING FABRIC CONDITIONING COMPOSITIONS

FIELD OF THE INVENTION

The present invention relates to a method for preparing a fabric conditioning composition, in particular a concentrated fabric conditioning composition. The invention further relates to a fabric conditioning composition obtained by the method.

BACKGROUND OF THE INVENTION

Fabric conditioning compositions are often used to deposit a fabric softening compound onto fabrics. These are usually rinse added fabric conditioning compositions. Typically, such compositions comprise a fabric softening agent dispersed in water. The fabric softening agent may be included at up to 7.5% by weight, in which case the compositions are considered dilute, or at levels from 7.5% to 60% by weight, in which case the compositions are considered concentrated.

Concentrated fabric conditioning compositions can suffer, and indeed are much more likely than dilute compositions to suffer from problems of instability both immediately after the composition is formed and during longer term storage.

Instability can manifest itself as a thickening of the composition. This thickening can occur to a level at which the composition is no longer pourable or dispersible in use, and, can even lead to the formation of an irreversible gel.

Such thickening is very undesirable because the composition can thereafter no longer be conveniently used, for example unpleasant residues can be left in the dispenser drawer of the washing machine and/or it is unattractive to the consumer.

Instability is particularly a problem when compositions are stored at high temperature, e.g. above 30° C.

It is obviously highly desirable for any fabric conditioning composition to provide excellent softening. It is known that better softening can be achieved using hardened (i.e. saturated) softening compounds instead of unsaturated or partially unsaturated softening compounds.

It is also desirable to use hardened (saturated) softening compounds as they are believed to have less base odour than unsaturated softening compounds, especially for TEA quats.

However, conditioning compositions comprising hardened softening compounds have been found in practice to be harder to formulate than those containing unsaturated or partially unsaturated softening compounds. For instance, additional viscosity modifiers and/or stabilisers not required when using unsaturated or partially unsaturated softening compounds are usually required in order to achieve a viscosity desirable to consumers, such as a thick, pourable liquid.

It is suggested that the viscosity of concentrated conditioning compositions comprising hardened softening compounds can be modified using nonionic surfactants. However, large amounts of such agents are typically required. Typically, they have to be included at levels in excess of 1.5% by weight, based on the total weight of the composition, and because such ingredients are expensive, their addition increases the cost of fabric conditioning compositions which include them.

This is especially true for compositions comprising hardened ester-linked quaternary ammonium softening compounds, in particular triethanolamine-based quaternary ammonium compounds (hereinafter referred to as 'TEA quats').

The present invention thus sets out to provide methods of preparing concentrated fabric conditioning compositions, and compositions prepared by said methods, which achieve viscosities desirable to consumers without the need to incorporate large quantities of components that are usually expensive.

The present inventors have found that a reduced amount of a particular nonionic active agent acts as a viscosity stabiliser for a fabric conditioning composition thereby providing a viscosity desired by consumers, even when included at very low levels (1.5% or less by weight in a fabric conditioning composition), when the composition is manufactured under certain conditions. In particular, it has been found that high-shear treatment of the composition below the phase transition temperature of the softener material provides the desired viscosity stability for a composition comprising said particular nonionic active agent.

WO 97/16516 discloses a softening composition comprising a cationic softener and a nonionic surfactant in a ratio of 1:2 to 4:1. There is no mention of formulating the composition under certain shear conditions.

EP 640121 discloses a composition comprising a diester quat and 0.1 to 30% of a viscosity/dispersibility modifier. There is no mention of hardened softening compounds.

EP 734433 discloses mixtures of hardened and partially unsaturated ester-linked quaternary ammonium materials. There is no mention of nonionic stabilising agents.

GB 2170829 discloses compositions comprising quaternary ammonium compounds and fatty alcohols in a ratio of 6:1 to 3:1. There is no mention of hardened quaternary ammonium compounds.

WO 99/29823 discloses a process for making a softener composition comprising forming a melt of a softener and optional additives, dispersing this in water, cooling to below the Krafft temperature of the softener and adding dye and nonionic material. There is no suggestion that the nonionic material can be incorporated before the mixture cools. Furthermore, there is no reference to high-shear milling.

EP 503221 discloses a composition comprising a cationic softener, a linear fatty alcohol ethoxylate and a highly branched fatty alcohol. There is no mention of a hardened cationic softener.

EP 309052 discloses compositions comprising 11 to 25% of a quaternised ester-amine, 0.1 to 10% of a linear alkoxylated alcohol with 1 to 10 alkylene oxide groups and 60% or more of a liquid carrier.

OBJECTS OF THE INVENTION

The present invention seeks to provide a method for forming a fabric conditioning composition and a fabric conditioning composition obtained by said method which overcomes one or more of the above-mentioned problems, and provides one or more of the aforementioned benefits.

SUMMARY OF THE INVENTION

According to the invention, there is provided a method for preparing a fabric conditioning composition comprising mixing with water:

(a) 7.5 to 60% by weight of a cationic fabric softening compound of formula (I), (II) or (III) as herein defined, the compound having one or more hydrocarbyl chains formed from parent fatty acyl compounds or fatty acids having an iodine value of from 0 to 20; and (b) 0.01%–1.5% by weight of a nonionic surfactant viscosity modifier; and (c) up to 1.4% by weight of a fatty alcohol wherein the combination of (b) and (c) is no more than 1.5% by weight, based on the total weight of the composition and the components (a), (b) and (c) are mixed to form an aqueous dispersion, the aqueous dispersion being subjected to high-shear below the phase transition temperature of compound (a) for a time sufficient to provide a composition having a viscosity of from 10 to 250 mPa·s measured at 20 $s^{-1}$ using a Haake MV1 Rotoviscometer at 25° C.

The invention further provides a fabric conditioning composition obtained by said method.

For the avoidance of doubt, the word "comprising" covers the normal meaning of the word "including" and is not limited to "consisting of" or "composed of". In other words the listed steps, options and components are not exhaustive.

DETAILED DESCRIPTION OF THE INVENTION

The compositions of the invention provide excellent initial and long term storage stability.

For the purposes of the present invention, the phrase 'initial stability' is defined as the viscosity stability at room temperature of the composition (measured over the initial 24 hour period after formation of the composition).

For the purposes of the present invention, the phrase 'long term storage stability' is defined as the viscosity stability of the composition stored over a 4 week period at 37° C.

All viscosity measurement are made using a Haake MV1 rotoviscometer at a shear rate of 20 $s^{-1}$.

Cationic Fabric Softening Compound

The cationic fabric softening compound is a quaternary ammonium compound having at least one ester group and having one or more hydrocarbyl chains formed from a parent fatty acyl group or acid having a degree of unsaturation represented by an iodine value (I.V.) of from 0 to 20, more preferably 0 to 5, even more preferably 0 to 2, e.g. 0 to 1 or even 0 to less than 1.

Thus, the softening compound is substantially or fully saturated (hardened).

It is considered advantageous to use a hardened (substantially or fully saturated) softening compound rather than an unsaturated or partially unsaturated compound since softening performance is generally better when using hardened softening compounds.

Also, hardened softening compounds are believed to have a lower base odour than unsaturated softening compounds. This is especially apparent when comparing saturated and unsaturated quaternary ammonium compounds based on triethanolamine (hereinafter referred to as "TEA").

Preferably the cationic softening compound has two $C_{12-28}$ alkyl or alkenyl groups connected to the nitrogen head group via at least one ester link. It is more preferred if the quaternary ammonium material has two ester links present.

Preferably, the average chain length of the alkyl or alkenyl group is at least $C_{14}$, more preferably at least $C_{16}$. Most preferably at least half of the chains have a length of $C_{18}$.

It is generally preferred if the alkyl or alkenyl chains are predominantly linear.

The first group of cationic fabric softening compounds for use in the invention is represented by formula (I):

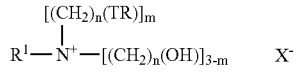

(I)

wherein each R is independently selected from a $C_{5-35}$ alkyl or alkenyl group, $R^1$ represents a $C_{1-4}$ alkyl, $C_{2-4}$ alkenyl or a $C_{1-4}$ hydroxyalkyl group,

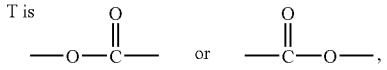

n is O or a number selected from 1 to 4, m is 1, 2 or 3 and denotes the number of moieties to which it relates that pend directly from the N atom, and $X^-$ is an anionic group, such as halides or alkyl sulphates, e.g. chloride, methyl sulphate or ethyl sulphate.

Especially preferred materials within this formula are di-alkenyl esters of triethanol ammonium methyl sulphate and N-N-di(tallowoyloxy ethyl) N,N-dimethyl ammonium chloride. A commercial example of a compound within this formula is Tetranyl AHT-1 (di-hardened oleic ester of triethanol ammonium methyl sulphate 80% active), ex Kao corporation.

It is also possible to include softening compounds with some degree of unsaturation, providing the overall IV of the parent fatty acyl compounds or fatty acids of the softening compounds remains below 20, preferably below 5, more preferably below 2. Compounds with low levels of unsaturation include the following from Tetranyl series: AT-1 (di-oleic ester of triethanol ammonium methyl sulphate 90% active), L5/90 (palm ester of triethanol ammonium methyl sulphate 90% active (supplied by Kao corporation). Other unsaturated quaternary ammonium materials include Rewoquat WE15 ($C_{10}$–$C_{20}$ and $C_{16}$–$C_{18}$ unsaturated fatty acid reaction products with triethanolamine dimethyl sulphate quaternised 90% active), ex Witco Corporation. If softening compounds with low levels of unsaturation are present in the composition, then the weight ratio of hardened compound to unsaturated compound is preferably greater than 4:1, more preferably greater than 6:1, e.g. 8:1 or more.

The second group of cationic fabric softening compounds for use in the invention is represented by formula (II):

Formula (II)

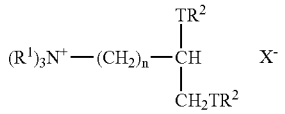

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; n is 0 or an integer from 1 to 5 and T and $X^-$ are as defined above.

Preferred materials of this class such as 1,2 bis[tallowoyloxy]-3-trimethylammonium propane chloride and 1,2-bis[oleyloxy]-3-trimethylammonium propane chloride and their method of preparation are, for example, described in U.S. Pat. No. 4,137,180 (Lever Brothers), the contents of which are incorporated herein. Preferably these materials also comprise small amounts of the corresponding monoester, as described in U.S. Pat. No. 4,137,180.

A third group of cationic fabric softening compounds for use in the invention is represented by formula (III)

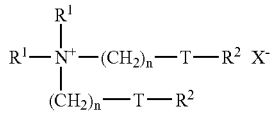

(III)

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; n is 0 or an integer from 1 to 5 and T and $X^-$ are as defined above.

The compositions comprise from 7.5 to 60% by weight of cationic softening material(active ingredient), based on the total weight of the composition, more preferably 8 to 45% by weight, most preferably 8 to 30% by weight or even 9 to 25% e.g. 11 to 22% by weight.

Iodine Value of the Parent Fatty Acyl group or Acid

The iodine value of the parent fatty acyl compound or acid from which the cationic softening material is formed is from 0 to 20, preferably from 0 to 5, more preferably from 0 to 2.

If there is any unsaturated softening compound present in the composition, the iodine value is calculated as the mean value of the parent fatty acyl compounds or fatty acids of the unsaturated together with the (substantially) saturated softening compounds.

In the context of the present invention, iodine value of the parent fatty acyl compound or acid from which the cationic surfactant is formed, is defined as the number of grams of iodine which react with 100 grams of the compound.

One method for calculating the iodine value of a parent fatty acyl compound/acid from which the cationic softening compound is formed, comprises dissolving a prescribed amount (from 0.1–3 g) into about 15 ml chloroform. The dissolved parent fatty acyl compound/fatty acid is then reacted with 25 ml of iodine monochloride in acetic acid solution (0.1M). To this, 20 ml of 10% potassium iodide solution and about 150 ml deionised water is added. After addition of the halogen has taken place, the excess of iodine monochloride is determined by titration with sodium thiosulphate solution (0.1M) in the presence of a blue starch indicator powder. At the same time a blank is determined with the same quantity of reagents and under the same conditions. The difference between the volume of sodium thiosulphate used in the blank and that used in the reaction with the parent fatty acyl compound or fatty acid enables the iodine value to be calculated. Other methods for calculating the IV of a parent fatty acyl compound or fatty acid of a softening compound will be apparent to the person skilled in the art.

Nonionic Surfactant Viscosity Stabiliser

The compositions comprise one or more nonionic surfactant viscosity stabilising agents.

Especially preferred nonionic surfactant viscosity stabilising agents for use in the compositions of the invention are alkoxylated nonionic fatty alcohols, such as fatty alcohols comprising $C_{10}$–$C_{22}$ alkyl/alkenyl chains alkoxylated with 3 to 30, more preferably 4 to 27, most preferably 6 to 25, e.g. 11 to 20 moles of alkoxy moieties. The fatty alcohols may be alkoxylated with ethylene oxide, propylene oxide or ethylene oxide/propylene oxide mixtures. Ethoxylated nonionic surfactants are especially preferred.

The viscosity stabilising agent is present in the composition in an amount from 0.01% to 1.5% by weight, more preferably from 0.1% to 1.3% by weight from 0.3% to 1.2% by weight, based on the total weight of the composition.

Fatty Alcohol

Optionally and advantageously, one or more un-alkoxylated fatty alcohols are present in the composition.

Preferred alcohols have a hydrocarbyl chain length of from 10 to 22 carbon atoms, more preferably 11 to 20 carbon atoms, most preferably 15 to 19 carbon atoms.

The fatty alcohol may be saturated or unsaturated, though saturated fatty alcohols are preferrred as these have been found to deliver greater benefits in terms of stability, especially low temperature stability.

Suitable commercially available fatty alcohols include tallow alcohol (available as Hydrenol S3, ex Sidobre Sinnova, and Laurex CS, ex Clariant).

The fatty alcohol content in the compositions is from 0 to 1.4% by weight, more preferably from 0.005 to 1.2% by weight, most preferably from 0.01 to 0.8% by weight, based on the total weight of the composition.

In the present invention, the particular method of preparing the composition enables lower levels of nonionic stabilising agent and fatty alcohol (if used) to be included in the compositions whilst maintaining excellent initial and long term viscosity stability.

Thus, the combined level of nonionic surfactant viscosity stabilising agent and fatty alcohol in the compositions of the invention does not exceed 1.5% by weight based on the total weight of the composition.

The weight ratio of the cationic softening material to the combined weight of the nonionic surfactant viscosity stabilising agent and optional fatty alcohol is preferably 5:1 to 50:1, more preferably 5:1 to 20:1, most preferably 5:1 to 15:1.

Water

The compositions of the invention are aqueous based.

Typically, the level of water present is from 0.5–92.49% by weight, more preferably 50–92% by weight, even more preferably 60–91% by weight, most preferably 70–90% by weight, based on the total weight of the composition.

Oils

The compositions of the present invention may comprise at least one oil.

The oil may be a mineral oil, a silicone oil, an ester oil and/or natural oils such as vegetable oils.

The ester oils are preferably hydrophobic in nature. They include fatty esters of mono or polyhydric alcohols having from 1 to 24 carbon atoms in the hydrocarbon chain, and mono or polycarboxylic acids having from 1 to 24 carbon atoms in the hydrocarbon chain, provided that the total number of carbon atoms in the ester oil is equal to or greater than 16, and that at least one of the hydrocarbon chains has 12 or more carbon atoms.

Suitable ester oils include saturated ester oils such as the PRIOLUBES (ex. Unichema). 2-ethyl hexyl stearate (PRIOLUBE 1545), neopentyl glycol monomerate (PRIOLUBE 2045) and methyl laurate (PRIOLUBE 1415) are particularly preferred although oleic monoglyceride (PRIOLUBE 1407) and neopentyl glycol dioleate (PRIOLUBE 1446) are also suitable.

It is preferred that the viscosity of the ester oil is from 2 to 400 mPa·s at a temperature of 25° C. at 106 $s^{-1}$, measured using a Haake rotoviscometer, and that the density of the mineral oil is from 0.8 to 0.9 $g \cdot cm^{-3}$ at 25° C.

Suitable mineral oils include branched or straight chain hydrocarbons having 6 to 35, more preferably 7 to 20, most preferably 7 to 14 carbon atoms in the hydrocarbon chain, although if no low molecular weight alcohol is present in the composition, then the hydrocarbon chain length of the oil will preferably be in the range 6 to 12 carbon atoms.

Preferred mineral oils include the Marcol technical range of oils (ex Esso) although particularly preferred is the Sirius range (ex Silkolene) or Semtol (ex. Witco Corp.).

Suitable silicone oils are described in co-pending application PCT/EP00/04223 (published as WO-A1-00/71806).

One or more oils of any of the above mentioned types may be used.

The oil may be present in an amount from 0.1 to 70% by weight, more preferably 0.2 to 20%, by weight most preferably 0.3 to 12%, e.g. 0.4 to 10% by weight based on the total weight of the composition.

The oil may be present as a component added into the composition separately from any other ingredient, or it may be present in other components of the composition, e.g. perfumes.

Solvent

In addition to any fatty alcohol which may be present in the compositions, the compositions may comprise one or more solvents.

The solvent may consist of a low molecular weight alcohol, such as a low molecular weight monohydric alcohol.

The presence of a lower molecular weight alcohol may also help to improve physical stability of the composition upon storage by lowering the viscosity to a more desired level.

Examples of suitable low molecular weight alcohols include ethanol, isopropanol, n-propanol, t-butyl alcohol, hexanol, heptanol, octanol, and the like.

It is especially preferred that the chain length of the hydrocarbon in the monohydric alcohol is 2 to 10, more preferably 3 to 9, most preferably 4 to 8 carbon atoms.

The alcohol may be branched or linear.

The solvent may be added to the composition either by being present as a component in the raw material comprising the cationic surfactant or it may be added separately. The solvent is preferably present in an amount from 0.05% to 40% by weight, more preferably from 0.1% to 25% by weight, most preferably from 0.15% to 16% by weight, based on the total weight of the composition.

Mixtures of solvents may be used if desired.

Dispersion Aids

The compositions may comprise dispersion aids. Typical dispersion aids include mono-long chain alkyl cationic quaternary ammonium compounds and mono-long chain alkyl amine oxides.

Preferably the concentration of the dispersion aid is from 0.05–30% by weight, more preferably from 0.3–20% by weight, most preferably from 1–15% by weight, based on the total weight of the composition.

Anti-Oxidation/Reduction Stabilisers

The compositions of the invention may, optionally, comprise one or more additional compounds which stabilise against oxidation and/or reduction.

If the stabilisers are present as anti-oxidants, they may be added at a level of from 0.005 to 2% by weight based on the total weight of the composition, more preferably from 0.01 to 0.2% by weight, most preferably from 0.035% to 0.1% by weight.

If present as an anti-reduction agent, then the stabiliser is preferably used in an amount from 0.001% to 0.2% by weight based on the total weight of the composition.

Co-active Softening Surfactants

Co-active softening surfactants for the cationic surfactant may also be incorporated in an amount from 0.01 to 20% by weight, more preferably 0.05 to 10%, based on the total weight of the composition. Preferred co-active softening surfactants are fatty acids, fatty amines and fatty N-oxides.

Perfumes

The compositions of the invention may also comprise one or more perfumes.

When present, the perfume is used in a concentration of preferably from 0.01–15% by weight, more preferably from 0.05–10% by weight, most preferably from 0.1–5% by weight, e.g. 0.15 to 4.5% by weight based on the total weight of the composition.

The perfume is preferably hydrophobic and has a ClogP value of 2.5 or more, more preferably 3 or more. For a discussion of ClogP and the method of its calculation, see WO 96/12785, of which the calculation method is incorporated by reference.

Other Optional Ingredients

The compositions may also contain one or more optional ingredients conventionally included in fabric conditioning compositions such as pH buffering agents, perfume carriers, fluorescers, colourants, hydrotropes, antifoaming agents, antiredeposition agents, polyelectrolytes, enzymes, optical brightening agents, anti-shrinking agents, anti-wrinkle agents, anti-spotting agents, germicides, fungicides, anti-corrosion agents, drape imparting agents, anti-static agents, ironing aids, skin care agents as disclosed in EP 0789070 and dyes.

Product Form

In its undiluted state at ambient temperature the product is in the form of an aqueous dispersion. Preferably the product is an aqueous dispersion of lamellar particles.

Phase Transition Temperature

Fabric conditioning compositions which comprise an aqueous dispersion of water insoluble cationic fabric softening compounds exist at ambient temperature as a phase which is a dispersion of lamellar droplets where the chains of the cationic softener exist in a solid or crystalline state (Lβ lamellar phase). As the temperature is raised the dispersed phase undergoes a transition to the Lα lamellar phase where the chains of the cationic softener (with or without co-actives) will exist in a more fluid or liquid state. The temperature at which this transition occurs is the "phase transition temperature" and will be apparent to the person skilled in the art. The shear must be applied according to the present invention at a temperature below this phase transition temperature. However, shear may, in addition, be carried out at higher temperatures. Typically the phase transition temperature is in the range 30–65° C. for cationic softeners with long saturated chains (e.g. greater than $C_{18}$).

For hardened TEA-based softening compounds, the phase transition temperature is from 30 to about 65° C.

If the softening material has more than one phase transition temperature, then the high shear must be carried out below the lowest phase transition temperature although it may in addition be carried out above this temperature.

The level and duration of shear can be used to control the viscosity of the final product.

Viscosity of the Product

The compositions have an initial viscosity as herein defined of from 10 to 250 mPa·s, preferably 15 to 200 mPa·s, most preferably 20 to 180 mPa·s at a shear rate at 20 $s^{-1}$ at 25° C., and a long term viscosity as herein defined of 10 to 250 mPa·s, preferably 15 to 200 mPa·s, most preferably 20 to 180 mPa·s at a shear rate at 20 $s^{-1}$ at 25° C. All measurements are made using a Haake MV1 rotoviscometer.

Thus, the compositions of the invention provide excellent initial stability and long term storage stability, especially at ambient and high temperature.

The composition is preferably used in the rinse cycle of a home textile laundering operation, where, it may be added directly to the washing machine, e.g. through a dispenser drawer. It can be diluted prior to use or can be added in an undiluted state. The compositions may also be used in a domestic hand-washing laundry operation.

Composition pH

When the composition is dispersed in water, the solution preferably has a pH of from 1.5 to 5.

Processing

The compositions of the invention are prepared according to any suitable method as long as the mixture is subjected to high shear below the phase transition temperature of the softening compound for a length of time sufficient to achieve a viscosity desirable to the consumer (from 10 to 250 mPa·s at a shear rate of 20 $s^{-1}$ measured using a Haake Rotoviscometer MV1 at a temperature of 25° C.). High shear can be achieved by using static or dynamic mills preferably, but not exclusively, in a side-loop. Examples of dynamic milling devices include Janke-Kunkel or Silverson high-shear mills. Examples of static milling devices include needle valves and orifice plates. High shear can also be achieved by sonolation. Other methods of achieving high shear will be apparent to those skilled in the art.

In the context of the present invention, high shear is defined as shear applied at an angular velocity (rpm) of from 3,000 to 10,000 where the number of batch volumes passing through a mill at the temperature below the phase transition temperature is from 0.5 to 4 batch volumes.

It will be apparent to those skilled in the art that at lower angular velocities, higher batch volumes will be required and at higher angular velocities, lower batch volumes will be required.

A particularly suitable method according to the invention for forming fabric conditioning compositions is described in method 1 below.

Method 1

A cationic softening material, a nonionic surfactant viscosity stabiliser and, optionally, a fatty alcohol are mixed under heating and stirring to form a melted premix. In a separate vessel, water, and optionally antifoam and preservative, are heated under stirring. The melted premix is added slowly to the contents of the vessel, preferably with stirring. The resulting mixture is gently cooled to just above ambient temperature. Stirring is continued throughout. Additional optional ingredients, such as dye and perfume, may then be added. During the process, the material is subjected to high shear, as defined above, at a temperature below the phase transition temperature of the cationic softening material until such a time that the acceptable viscosity is reached.

EXAMPLES

The invention will now be illustrated by the following non-limiting examples. Further modification within the scope of the present invention will be apparent to the person skilled in the art.

Examples of the invention are denoted by a number whilst comparative examples are denoted by a letter.

Unless otherwise stated, all values are in percentage by weight based on the total weight of the composition.

Compositions 1 to 8 and B to E were prepared according to method 1 described above.

Composition A was prepared according to the following prior art method.

Prior Art Method

The cationic surfactant, nonionic stabiliser and fatty alcohol are mixed under heating with stirring to form a melted premix. In a separate vessel, water, antifoam and preservative are heated with stirring. The melted premix is added slowly to the contents of the vessel. The mixture is gently cooled to just above ambient temperature and stirring is continued throughout. Optional ingredients such as dye and perfume may then be added. The mixture was not subjected to high shear below the phase transition temperature for a period to give a viscosity of from 10 to 250 mPa·s at a shear rate of 20 $s^{-1}$ measured using a Haake Rotoviscometer MV1 at a temperature of 25° C.

The compositions are given in table 1, below.

TABLE 1

| Example | A | B | C | 1 | 2 | 3 | 4 | 5 | 6 | 7 | 8 | D | E |
|---|---|---|---|---|---|---|---|---|---|---|---|---|---|
| Cationic surfactant[a] | 13 | 12.5 | 12.5 | 13 | 12.5 | 12.5 | 12.5 | 12.5 | 12 | 12 | 12 | 12 | 12 |
| Nonionic viscosity stabiliser[b] | 0.75 | 1.8 | 2 | 0.75 | 0.75 | 0.75 | 0.75 | 0.6 | 0.75 | 0.75 | 0.75 | 1.6 | 1.8 |
| Fatty alcohol[c] | 0.6 | — | — | 0.75 | 0.5 | 0.6 | 0.75 | 0.6 | 0.5 | 0.6 | 0.75 | — | — |
| Preservative | ← Minor → | | | | | | | | | | | | |
| Dye | ← Minor → | | | | | | | | | | | | |
| Antifoam | ← Minor → | | | | | | | | | | | | |
| Perfume | ← 0.95 → | | | | | | | | | | | | |
| Water | ← To 100 → | | | | | | | | | | | | |

[a]Tetranyl AHT1 (ex Kao). An ester-linked guaternary ammonium material based on TEA and having an IV of less than 1.

[b]Genapol C200. Coco-20 EO (ex Clariant)

[c]Hydrenol S3. Tallow alcohol (ex Sidobre Sinnova)

The results are given in table 2.

TABLE 2

| Storage time (days/weeks) | Shear rate ($s^{-1}$) | Example A | B | C | 1 | 2 | 3 | 4 | 5 | 6 | 7 | 8 | D | E |
|---|---|---|---|---|---|---|---|---|---|---|---|---|---|---|
| 0 days at 25° C. | 20 | 354 | 92 | 128 | 169 | 103 | 148 | 145 | 111 | 123 | 118 | 107 | 129 | 112 |
| | 106 | 146 | 43 | 52 | 86 | 54 | 69 | 63 | 54 | 68 | 60 | 53 | 61 | 53 |
| 1 day at 25° C. | 20 | 160 | 91 | — | 133 | 86 | 102 | 90 | 76 | 90 | 87 | 74 | 98 | 122 |
| | 106 | 76 | 40 | — | 67 | 39 | 45 | 42 | 36 | 48 | 42 | 39 | 49 | 54 |
| 4 weeks at 37° C. | 20 | 276 | 421 | 445 | 210 | 112 | 127 | 116 | 103 | 124 | 115 | 110 | 289 | 435 |
| | 106 | 107 | 155 | 174 | 105 | 60 | 63 | 52 | 56 | 59 | 51 | 52 | 115 | 147 |
| 6 weeks at 37° C. | 20 | 112 | — | — | — | 77 | 89 | — | — | — | — | — | — | — |
| | 106 | 52 | — | — | — | 45 | 42 | — | — | — | — | — | — | — |

The viscosity measurements were taken at the shear rates indicated in the table using a Haake MV1 Rotoviscometer at 25° C.

Comparison of example A with example 1 shows that compositions formed according to method 1 exhibited significantly improved initial viscosity stability over the composition prepared according to the prior art method.

Comparison of the viscosity stability results for examples B to E with examples 1 to 8, all of which were prepared according to method 1 above, demonstrates that there is a marked improvement in the stability of the compositions on storage (especially high temperature stability upon storage) obtained by restricting the total amount of the nonionic surfactant viscosity stabiliser and fatty alcohol in the compositions.

Thus, there is a clear synergistic benefit provided by the specific conditions of production and the limitation of the nonionic viscosity stabiliser plus fatty alcohol level to 1.5% by weight.

The invention has been described by way of example only. Further modifications within the scope of the invention will be apparent to the person skilled in the art.

The invention claimed is:

1. A method for preparing a fabric conditioning composition comprising mixing with water:

(a) 7.5 to 60% by weight of a cationic fabric softening compound of formula (I), (II) or (III):

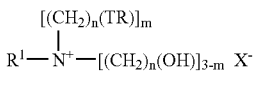

(I)

wherein each R is independently selected from a $C_{5-35}$ alkyl or alkenyl group, $R^1$ represents a $C_{1-4}$ alkyl, $C_{2-4}$ alkenyl or a $C_{1-4}$ hydroxyalkyl group,

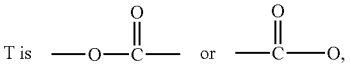

n is O or a number selected from 1 to 4, m is 1, 2 or 3 and denotes the number of moieties to which it relates that pend directly from the N atom, and $X^-$ is an anionic group;

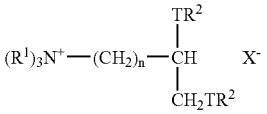

(II)

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; n is 0 or an integer from 1 to 5 and T and $X^-$ are as defined above;

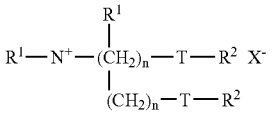

(III)

wherein each $R^1$ group is independently selected from $C_{1-4}$ alkyl, or $C_{2-4}$ alkenyl groups; and wherein each $R^2$ group is independently selected from $C_{8-28}$ alkyl or alkenyl groups; n is 0 or an integer from 1 to 5 and T and $X^-$ are as defined above;

the compound having one or more hydrocarbyl chains formed from parent fatty acyl compounds or fatty acids having an iodine value of from 0 to 20; and (b) 0.01%–1.5% by weight of a nonionic surfactant viscosity modifier; and (c) about 0.01% to about 1.4% by weight of a fatty alcohol; wherein said fatty alcohol is un-alkoxytated and contains about 15 to about 22 carbon atoms in a hydrocarbyl chain;

wherein the combination of (b) and (c) is no more than 1.5% by weight, based on the total weight of the composition;

and wherein components (a), (b) and (c) are mixed to form an aqueous dispersion, the aqueous dispersion being subjected to high-shear below the phase transition temperature of component (a) for a time sufficient to provide a composition having a viscosity of from 10 to 250 mPa·s measured at 20 $s^{-1}$ using a Haake MV1 Rotoviscometer at 25° C.

2. A method according to claim 1 wherein components (a), (b), (c) are melted together to form a premix prior to mixing with water.

3. A fabric conditioning composition obtainable by the method of claim 1.

4. A composition according to claim 3 comprising a cationic fabric softening compound of formula (I).

5. A composition according to claim 3 wherein the weight ratio of cationic softening material to the combined weight of the nonionic surfactant viscosity modifier and fatty alcohol is 5:1 to 50:1.

6. A composition according to claim 3 wherein the cationic softening material in present in an amount from 11 to 22% by weight, based on the total weight of the composition.

7. A composition as claimed in claim 3 wherein the nonionic surfactant viscosity modifier is a $C_{10-22}$ fatty alcohol having an alkoxylation number of 3 to 30.

8. A method for preparing a fabric conditioning composition comprising mixing with water:

(a) 7.5 to 60% by weight of a cationic fabric softening compound of formula (I), (II) or (III);

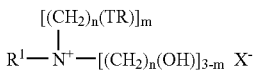

(I)

wherein each R is independently selected from a $C_{5-35}$ alkyl or alken group, $R^1$ represents a $C_{1-4}$ alkyl, $C_{2-4}$ alkenyl or a $C_{1-4}$ hydroxyalkyl group,

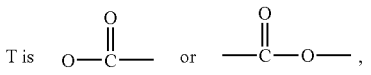

n is O or a number selected from 1 to 4, m is 1, 2 or 3 and denotes the number of moieties to which it relates that pend directly from the N atom, and $X^-$ is an anionic group:

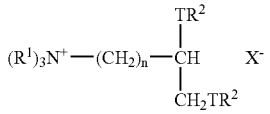

(II)

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; n is 0 or an integer from 1 to 5 and T and $X^-$ are as defined above;

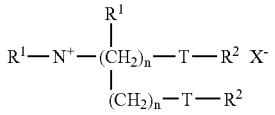

(III)

wherein each $R^1$ group is independently selected from $C_{1-4}$ alkyl, or $C_{2-4}$ alkenyl groups: and wherein each $R^2$ group is independently selected from $C_{8-28}$ alkyl or alkenyl groups: n is 0 or an integer from 1 to 5 and T and $X^-$ are as defined above;

the compound having one or more hydrocarbyl chains formed from parent fatty acyl compounds or fatty acids having an iodine value of from 0 to 20; and (b) 0.01%–1.5% by weight of a nonionic surfactant viscosity modifier; and (c) up to 1.4% by weight of a fatty alcohol wherein the combination of (b) and (c) is no more than 1.5% by weight, based on the total weight of the composition;

and wherein components (a), (b) and (c) are mixed to form an aqueous dispersion, the aqueous dispersion being subjected to high-shear below the phase transition temperature of component (a) for a time sufficient to provide a composition having a viscosity of from 10 to 250 mPa·s measured at 20 $s^{-1}$ using a Haake MV1 Rotoviscometer at 25° C;

wherein the high shear is applied at an angular velocity of from 3,000 to 10,000 rpm where the number of batch volumes passing through a mill below the phase transition temperature is from 0.5 to 4 batch volumes.

* * * * *